US008910882B2

(12) United States Patent
Moore et al.

(10) Patent No.: US 8,910,882 B2
(45) Date of Patent: Dec. 16, 2014

(54) FUEL INJECTOR HAVING REDUCED ARMATURE CAVITY PRESSURE

(75) Inventors: Bryan D. Moore, Washington, IL (US); Daniel R. Ibrahim, Metamora, IL (US); Sana Mahmood, Bloomington, IL (US); Adam Duresky, Niceville, FL (US); Christopher D. Hanson, Fargo, ND (US)

(73) Assignee: Caterpillar Inc., Peoria, IL (US)

( * ) Notice: Subject to any disclaimer, the term of this patent is extended or adjusted under 35 U.S.C. 154(b) by 812 days.

(21) Appl. No.: 13/167,528

(22) Filed: Jun. 23, 2011

(65) Prior Publication Data

US 2012/0325926 A1 Dec. 27, 2012

(51) Int. Cl.
*F02D 1/06* (2006.01)

(52) U.S. Cl.
USPC ..... 239/5; 239/96; 239/124; 239/125; 239/132; 239/132.3; 239/585.1; 239/585.3; 123/472

(58) Field of Classification Search
USPC ..... 239/88, 96, 124, 125, 132, 132.1, 239/132.3, 132.5, 585.1, 585.3, 5; 123/472; 251/129.15, 129.16
See application file for complete search history.

(56) References Cited

U.S. PATENT DOCUMENTS

| | | | | |
|---|---|---|---|---|
| 3,398,895 | A | 8/1968 | Claffey | |
| 4,753,205 | A | 6/1988 | Knapp et al. | |
| 5,325,838 | A | 7/1994 | Bennett | |
| 5,651,501 | A * | 7/1997 | Maley et al. | 239/88 |
| 6,168,091 | B1 * | 1/2001 | Rodier et al. | 239/124 |
| 6,279,603 | B1 | 8/2001 | Czarnik et al. | |
| 6,336,595 | B1 * | 1/2002 | Barbier | 239/96 |
| 6,422,210 | B1 | 7/2002 | Lambert et al. | |
| 6,463,916 | B1 | 10/2002 | Coplin et al. | |
| 6,880,766 | B2 * | 4/2005 | Lewis et al. | 239/88 |
| 7,013,876 | B1 | 3/2006 | Puckett et al. | |
| 7,021,558 | B2 | 4/2006 | Chenanda et al. | |
| RE40,500 | E | 9/2008 | Doers et al. | |
| 8,128,005 | B2 * | 3/2012 | Magel | 239/125 |
| 2010/0186719 | A1 | 7/2010 | Venkataraghavan et al. | |

* cited by examiner

*Primary Examiner* — Steven J Ganey

(74) *Attorney, Agent, or Firm* — Finnegan, Henderson, Farabow, Garrett & Dunner LLP

(57) ABSTRACT

A fuel injector for an engine is disclosed. The fuel injector may have a fuel nozzle with at least one injection orifice, and a needle element movable within the fuel nozzle between a first position at which the needle element inhibits fuel flow and a second position at which fuel flow is substantially uninhibited. The fuel injector may also have a control chamber located at a base end of the needle element, a body, and a control valve disposed within the body and movable to selectively drain the control chamber, thereby causing the needle element to move between the first and second positions. The fuel injector may further have an armature disposed within an armature cavity of the body and selectively energized to move the control valve, and a pressure reducer disposed within the body and configured to reduce a pressure of the armature cavity.

14 Claims, 4 Drawing Sheets

FUEL INJECTOR HAVING REDUCED ARMATURE CAVITY PRESSURE

TECHNICAL FIELD

The present disclosure is directed to a fuel injector and, more particularly, to a fuel injector having a reduced armature cavity pressure.

BACKGROUND

Common rail fuel injectors provide a way to introduce fuel from a common supply rail into the combustion chambers of an engine. Typical common rail fuel injectors include an actuating solenoid that opens a control valve, which regulates a fuel pressure at one side of a check. As the pressure drops at the check, the check lifts and fuel injection begins. As the pressure increases at the check, the check closes and fuel injection ends. Accordingly, fuel is injected as a function of the time period during which an armature of the solenoid is energized. An example of such a fuel injector is disclosed in U.S. Pat. No. 7,013,876 of Puckett et al. that issued on Mar. 21, 2006.

A widespread problem associated with common rail fuel injectors is known as injector bounce. Injector bounce can occur when the control valve is closed quickly and it bounces away from an associated seat. When the control valve bounces away from its seat, a delay in the closing of the control valve is created that can lead to a delay in injection termination and/or an additional injection of fuel. Injection delay and additional injections can reduce engine efficiencies and cause unstable engine operation.

The fuel injector of the present disclosure addresses one or more of the problems set forth above and/or other problems of the prior art.

SUMMARY

One aspect of the present disclosure is directed to an insert for use with an armature assembly. The insert may include an upper surface configured to fluidly communicate with a cavity of the armature assembly, a lower surface located opposite the upper surface and configured to engage a wall of the armature assembly, and a central bore passing from the upper surface to the lower surface and configured to receive a pin of the armature assembly. The insert may also include a first passage formed at least partially within the lower surface and having an effuser portion, a neck portion, and a diffuser portion; and a second passage extending from the neck portion to the upper surface.

Another aspect of the present disclosure is directed to an armature assembly. The armature assembly may include a body having an armature cavity, an armature disposed within the armature cavity, and an insert disposed within the armature cavity. The insert may have at least a portion of a venturi formed therein that is configured to reduce a pressure of the armature cavity.

Yet another aspect of the present disclosure is directed to a fuel injector. The fuel injector may include a fuel nozzle having at least one injection orifice, and a needle element having a tip end and a base end. The needle element may be movable within the fuel nozzle between a first position at which the tip end of the needle element inhibits fuel flow through the at least one injection orifice, and a second position at which fuel flow through the at least one injection orifice is substantially uninhibited by the tip end of the needle element. The fuel injector may also include a control chamber located at the base end of the needle element, a body, and a control valve disposed within the body and movable to selectively drain the control chamber, thereby causing the needle element to move between the first and second positions. The fuel injector may further include an armature disposed within an armature cavity of the body and selectively energized to move the control valve, and a pressure reducer disposed within the body and configured to reduce a pressure of the armature cavity.

Another aspect of the present disclosure is directed to a method of injecting fuel. The method may include directing high-pressure fuel into a nozzle of a fuel injector, and directing low-pressure coolant into an armature cavity of the fuel injector. The method may further include energizing an armature within the armature cavity to allow the high-pressure fuel to be discharged from the nozzle, and reducing a pressure of the low-pressure coolant within the armature cavity below a vaporization point.

DETAILED DESCRIPTION

Figure 1:
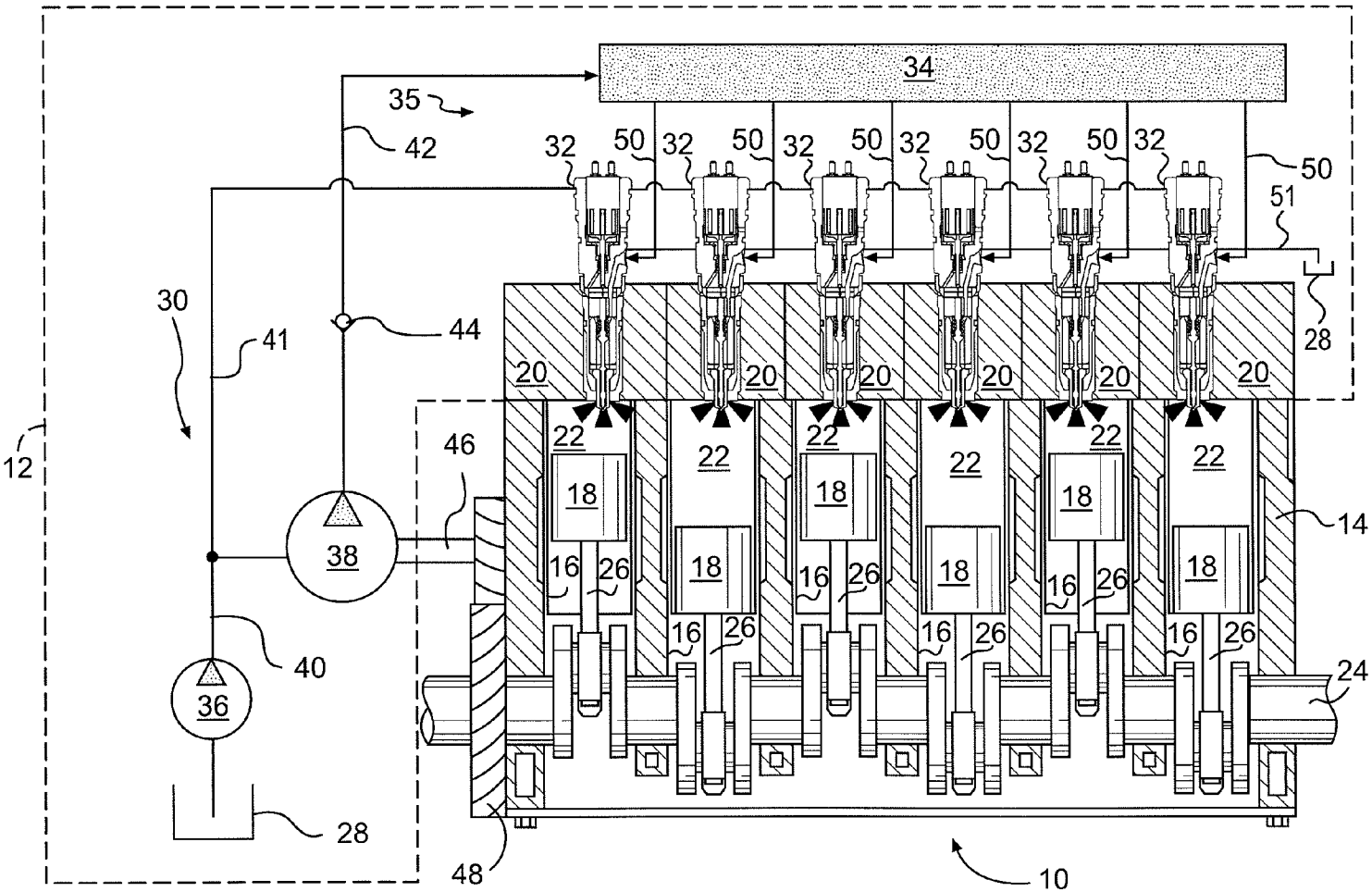
FIG. 1 is a partial cross-sectional and diagrammatic illustration of an exemplary disclosed fuel system.

FIG. 1 illustrates an engine 10 and an exemplary embodiment of a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a liquefied gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 together may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or another suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into combustion chambers 22 during each rotation of crankshaft 24. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a common rail 34.

Fuel pumping arrangement 30 may include one or more pumping devices that function to increase the pressure of the fuel drawn from tank 28, and direct one or more pressurized streams of fuel to common rail 34. In one example, fuel pumping arrangement 30 includes a low-pressure source 36 and a high-pressure source 38 disposed in series and fluidly connected by way of a fuel line 40. Low-pressure source 36 may be a transfer pump configured to provide low-pressure feed to high-pressure source 38 and, for cooling purposes, directly to fuel injectors 32. Low-pressure source 38 may be connected to fuel injectors 32 by way of a fuel line 41. High-pressure source 38 may be configured to receive the low-pressure feed and to increase the pressure of the fuel to the range of about 30-300 MPa. High-pressure source 38 may be connected to common rail 34 by way of a fuel line 42. A check valve 44 may be disposed within fuel line 42 to provide for one-directional flow of fuel from fuel pumping arrangement 30 to common rail 34.

One or both of low-pressure and high-pressure sources 36, 38 may be operably connected to engine 10 and driven by crankshaft 24. Low and/or high-pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high-pressure source 38 is shown in FIG. 1 as being connected to crankshaft 24 through a gear train 48. It is contemplated, however, that one or both of low and high-pressure sources 36, 38 may alternatively be driven electrically, hydraulically, pneumatically, or in any other appropriate manner.

Fuel injectors 32 may be disposed within cylinder heads 20 and connected to common rail 34 by way of a plurality of fuel lines 50 and to tank 28 by way of a drain line 51. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for after-treatment regeneration.

Figure 2:
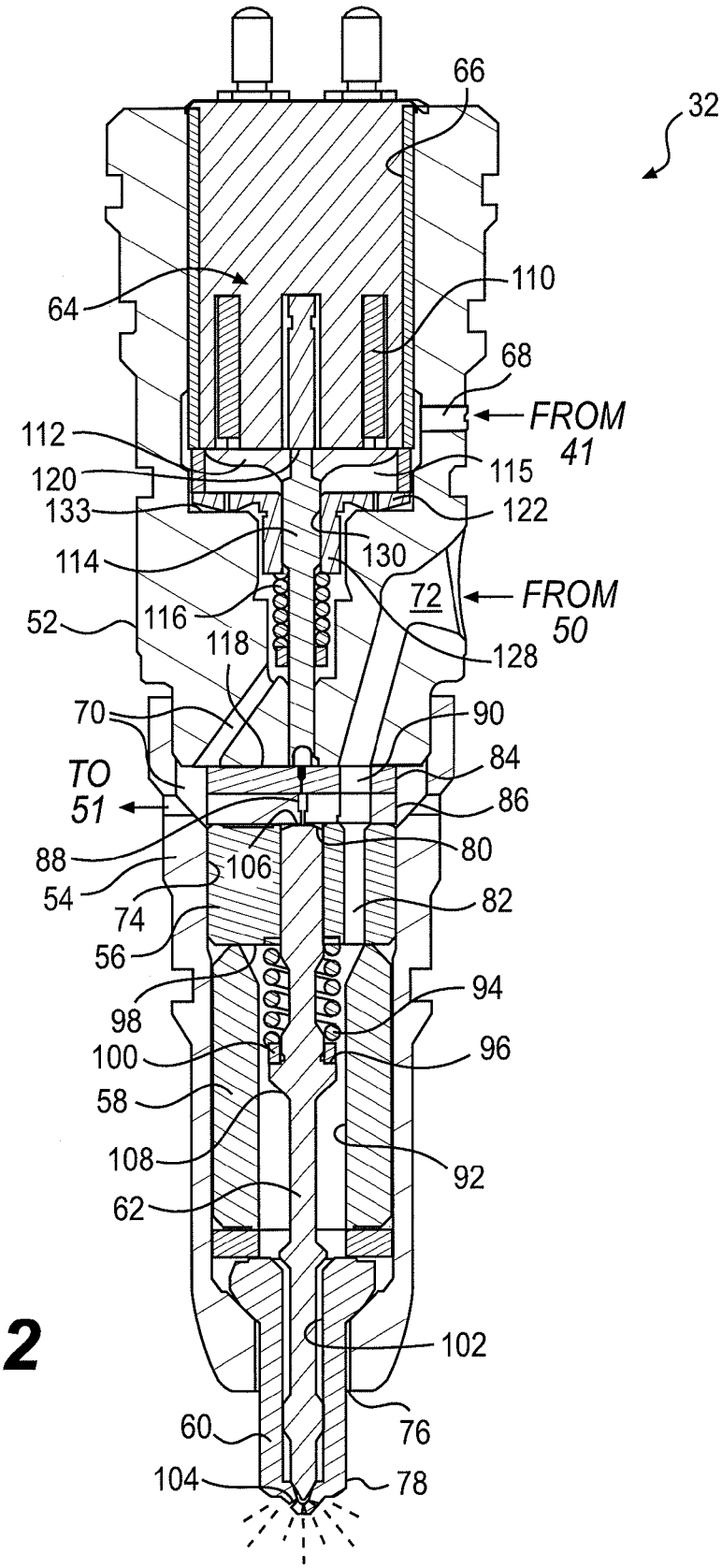
FIG. 2 is a cross-sectional illustration of an exemplary disclosed fuel injector that may be used with the fuel system of FIG. 1.

As illustrated in FIG. 2, each fuel injector 32 may be a closed nozzle unit fuel injector. Specifically, each fuel injector 32 may include a body 52; a nozzle case 54 operably connected to injector body 52; and a guide 56, a sleeve 58, and a nozzle 60 disposed at least partially within nozzle case 54. Fuel injector 32 may also include a needle element 62 located within nozzle 60, and a solenoid actuator 64 disposed within body 52 at an end of injector 32 that is opposite nozzle 60. It is contemplated that additional components may be included within fuel injector 32 such as, for example, pressure-balancing passageways, accumulators, and other injector components known in the art.

Injector body 52 may embody a cylindrical member configured for assembly within cylinder head 20 and having one or more passageways. In the disclosed embodiment, injector body 52 includes a central bore 66 configured to receive solenoid actuator 64, a low-pressure fuel inlet 68, a low-pressure fuel outlet 70, and a high-pressure fuel inlet 72. It is contemplated, however, that additional, fewer, and/or different passages may be included within injector body 52, if desired. Low-pressure fuel inlet 68 may extend radially inward from fuel line 41 to central bore 66 to supply solenoid actuator 64 with low-pressure fuel that acts as a coolant to chill solenoid actuator 64 during operation. Low-pressure fuel outlet 70 may extend radially back outward from central bore 66, at a location closer toward nozzle 60 than low-pressure fuel inlet 68, to an outer cylindrical surface of body 52 to direct the now warmer fuel to drain line 51. High-pressure fuel inlet 72 may extend from the outer cylindrical surface of body 52 to an axial interface with guide 56.

Nozzle case 54 may embody a cylindrical member having a central bore 74 configured to receive guide 56, sleeve 58, and nozzle 60. Nozzle case 54 may also include an opening 76 through which a tip end 78 of nozzle 60 protrudes.

Guide 56 may embody a cylindrical member axially aligned with body 52 and disposed within nozzle case 54, between body 52 and sleeve 58. Guide 56 may have an internally formed control chamber 80 that is in direct communication with a base end of needle element 62, and a radially offset high-pressure fuel passage 82 that connects high-pressure fuel inlet 72 with sleeve 58. Control chamber 80 may be selectively drained of or supplied with pressurized fuel to affect a reciprocating motion of needle element 62. In the disclosed embodiment, one or more orifice plates 84, 86 may be disposed between guide 56 and body 52, if desired. Orifice plates 84, 86 may include a common control passage 88 that extends from central bore 66 of body 52 to control chamber 80, and a common high-pressure passage 90 that extends from high-pressure inlet 72 of body 52 to high-pressure fuel passage 82 within guide 56.

Sleeve 58 may also embody a cylindrical member having a central bore 92 configured to receive needle element 62 and a return spring 94. Return spring 94 may be disposed between a stop 96 and an end seating surface 98 of guide 56 to axially bias needle element 62 toward tip end 78 of nozzle 60. A spacer 100 may be disposed between return spring 94 and stop 96 to reduce wear of the components within fuel injector 32 and/or to set a load of return spring 94, as desired.

Nozzle 60 may likewise embody a cylindrical member and have a central bore 102 configured to receive needle element 62. A space between walls of central bore 102 and needle element 62 may form a pressure chamber that holds a supply of pressurized fuel received from high-pressure passage 82 in anticipation of an injection event. Nozzle 60 may also include one or more orifices 104 that allow the pressurized fuel to flow from the pressure chamber and into combustion chambers 22 of engine 10, as needle element 62 is moved away from orifices 104.

Needle element 62 may be an elongated cylindrical member that is slidingly disposed within guide 56, sleeve 58, and nozzle 60. Needle element 62 may be axially movable between a first position at which a tip end of needle element 62 substantially blocks a flow of fuel through orifices 104, and a second position at which orifices 104 are open to allow a flow of fuel into combustion chamber 22. It is contemplated that needle element 62 may be a multi-member element having a needle member and a piston member or a single element having an integral piston surface at its base end, as desired.

Needle element 62 may have multiple driving hydraulic surfaces. For example, needle element 62 may include a first hydraulic surface 106 and a second hydraulic surface 108. First hydraulic surface 106 may tend to drive needle element 62 with the bias of return spring 94 toward a first or orifice-blocking position when acted upon by pressurized fuel. Second hydraulic surface 108 may tend to opposes the bias of return spring 94 and drive needle element 62 in the opposite direction toward a second or orifice-opening position when acted upon by pressurized fuel.

Solenoid actuator 64 may be disposed at an end of injector 32 that is opposite nozzle 60 to control the forces acting on needle element 62. In particular solenoid actuator 64 may include windings 110 of a suitable shape and size through which current may flow to establish a magnetic field, and an armature 112 associated with windings 110. Armature 112 may be fixedly connected to a two-position armature pin 114 within a cavity 115 and, when windings 110 are energized, the magnetic field established by windings 110 may urge armature 112 and connected armature pin 114 against the bias of a return spring 116 from a first or non-injecting position to a second or injecting position. For example, armature pin 114 may be moved between a lower seat 118 and an upper seat 120.

When windings 110 are not energized, spring 116 may be allowed to move armature pin 114 into the non-injecting position (i.e., down against lower seat 118, as shown in FIG. 2), and fuel may flow from high-pressure fuel inlet 72, through passage 90, and into control chamber 80 via a cross-drilled radial passage (not shown). The pressurized fuel within control chamber 80 may generate a downward force at hydraulic surface 106 that combines with the force of return spring 94 to overcome any upward force at hydraulic surface 108 and move needle element 62 to close orifices 104 and terminate fuel injection. When windings 110 are energized, fuel may flow from control chamber 80 to tank 28 via passage 88, central bore 66, and low-pressure fuel outlet 70. As fuel from control chamber 80 drains to tank 28, the upward force of pressurized fluid acting on hydraulic surface 108 may urge needle element 62 against return spring 94, thereby opening orifices 104 and initiating fuel injection into combustion chambers 22. When windings 110 are subsequently de-energized, return spring 116 may return armature pin 114 to the non-injecting position. In this manner, the timing and level of the induced current within windings 110 may be controlled to affect fuel injection.

Figure 3:
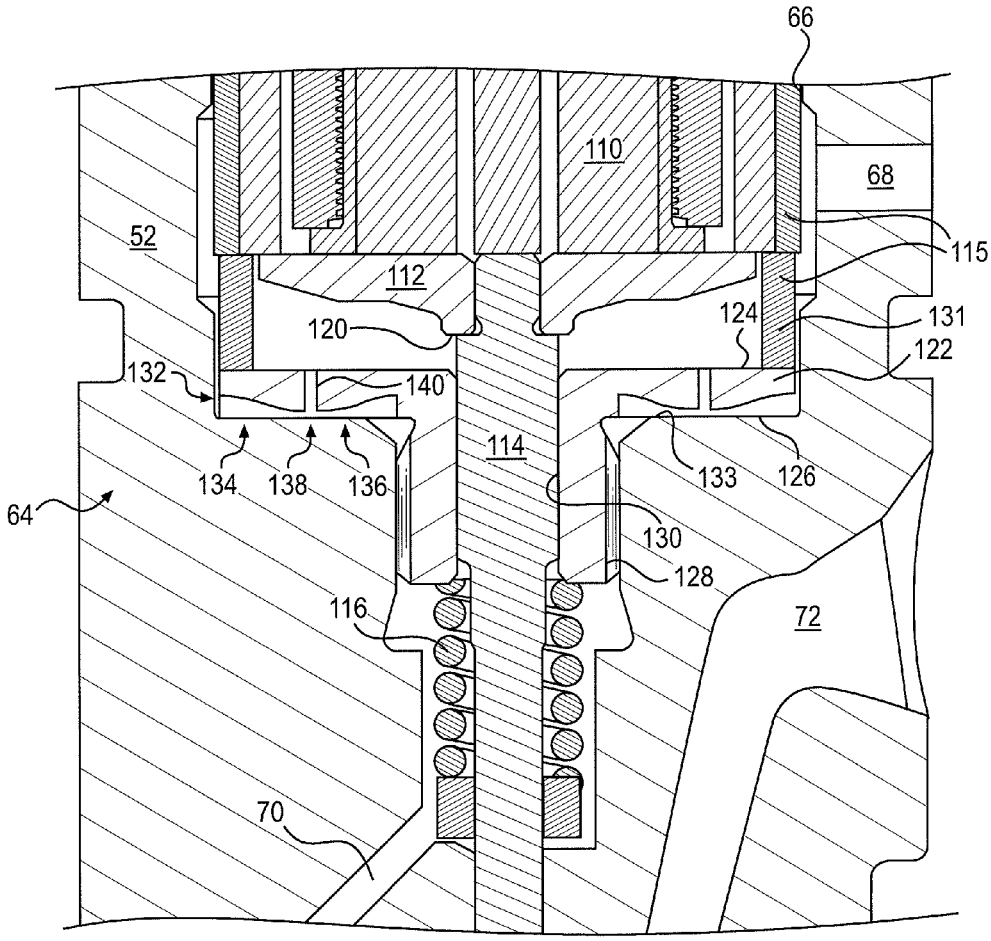
FIG. 3 is a cross-sectional illustration of a portion of the fuel injector of FIG. 2.

Solenoid actuator 64 may also be provided with an insert 122 that simultaneously functions as a pressure reducer for armature cavity 115, a retainer for spring 116, and a guide for armature 112. As shown in FIG. 3, insert 122 may generally include an upper surface 124 oriented toward armature 112 when assembled, and a lower surface 126 located opposite upper surface 124. Insert 122 may also include a protrusion 128 that extends distally away from lower surface 126 to engage and thereby retain spring 116 in position within central bore 66 of body 52. A smaller central bore 130 may stretch from upper surface 124 through protrusion 128 and be configured to slidingly receive armature pin 114. An air gap spacer 131 located at a periphery of armature cavity 115 may press against upper surface 124 and thereby hold insert 122 in place against a shoulder 133 of central bore 66.

Insert 122, together with shoulder 133, may form a venturi 132 at the interface of insert 122 and shoulder 133. In particular, insert 122 may include grooves within lower surface 126 that, together with shoulder 133 form a passage having an effuser portion 134, a diffuser portion 136, and a neck portion 138 located between effuser portion 134 and diffuser portion 136 (i.e., venturi 132 may be partially formed by each of insert 122 and shoulder 133). As can be seen in FIG. 3, both effuser and diffuser portions 134, 136 may have gradually reducing heights (e.g., curvilinear as in FIG. 3 or angular as in FIGS. 4 and 5) near neck portion 138. In the disclosed embodiment, effuser portion 134 may have a greater inlet opening area (i.e., height and width) and a shorter length than the outlet opening area and length diffuser portion 136, which relationship may result in a greater pressure drop across neck portion 138. Effuser portion 134 may be fluidly connected to low-pressure fuel inlet 68, while diffuser portion 136 may be fluidly connected to low-pressure outlet 70. Accordingly, low-pressure fuel may flow from inlet 68, into effuser portion 134, through neck portion 138 where the flow of fuel is restricted causing a velocity of the fuel to increase, into diffuser portion 136, and out of injector 32 via low-pressure outlet 70. Insert 122 may also include an axial passage 140 that extends from upper surface 124 of insert 122 to neck portion 138. In this configuration, fuel flow through venturi 132 may create a low-pressure within passage 140, thereby functioning to reduce a pressure within armature cavity 115.

Figure 5:
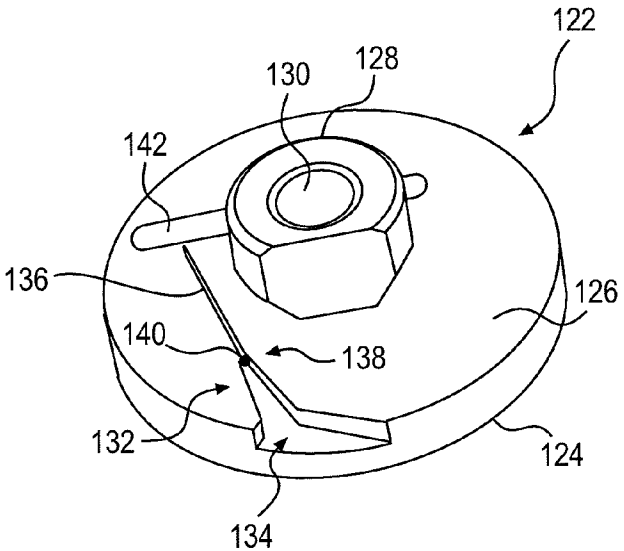
FIG. 5 is a pictorial illustration of an insert of the fuel injector of FIG. 2.
Figure 4:
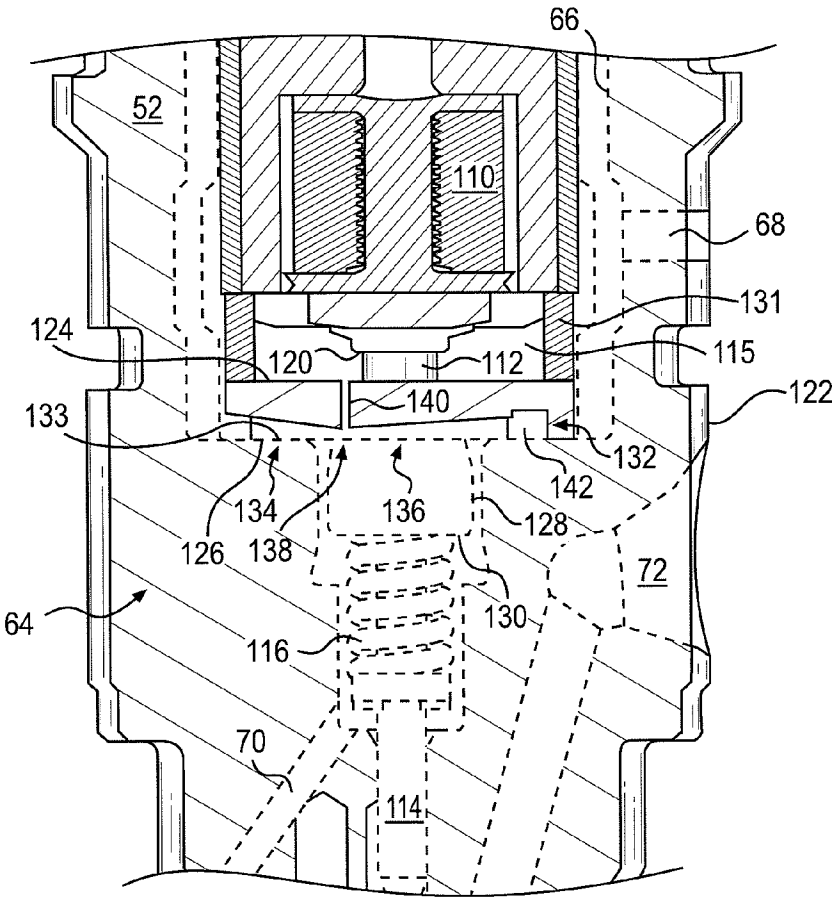
FIG. 4 is another cross-sectional illustration of a portion of the fuel injector of FIG. 2.

Insert 122 may include any number of venturis 132 and axial passages 140 located around protrusion 128. For example, insert 122 of FIG. 3 is shown as including two different venturis 132 and two different passages 140, each venturi 132/passage 140 pair located to one side of protrusion 128. In this configuration, venturi 132 may have an overall length less than a radius of insert 122. In the embodiment of FIGS. 4 and 5, however, only a single venturi 132 and a single passage 140 are illustrated. In this configuration, venturi 132 may have an overall length greater than a radius of insert 122. Because of the length of venturi 132 in the embodiment of FIGS. 4 and 5, an additional passage 142 may be required to properly connect diffuser portion 136 to low-pressure fuel outlet 70.

INDUSTRIAL APPLICABILITY

The fuel injector of the present disclosure has wide application in a variety of engine types including, for example, diesel engines, gasoline engines, and liquefied gaseous fuel-powered engines. The disclosed fuel injector may be used in conjunction with any engine where consistent performance is important. The operation of fuel injector 32 will now be explained.

During normal operation of engine 10, high-pressure fuel and low-pressure fuel may be supplied to each injector 32 by fuel pumping arrangement 30 (referring to FIG. 1). Specifically, high-pressure fuel may be supplied by high-pressure source 38 to high-pressure fuel inlet 72 (referring to FIG. 2) via passage 42, common rail 34, and fuel lines 50. The high-pressure fuel may enter fuel injector 32 via high-pressure fuel inlet 72, travel through passages 90, 82, and 92, and into central bore 102, where the fuel awaits an injection event. In addition, the high-pressure fuel from passage 90 may fill control chamber 80 in preparation for the injection event. Low-pressure fuel may be simultaneously supplied as a coolant by low-pressure source 36 to low-pressure fuel inlet 68 via fuel line 41. The low-pressure fuel may enter fuel injector 32 via low-pressure fuel inlet 68, pass through venturi 132 and the end of central bore 66 near spring 116, and exit fuel injector 32 via low-pressure outlet 70.

Solenoid actuator 64 may be energized to initiate injections of fuel into combustion chambers 22 (referring to FIG. 1). In particular, when an electrical current is applied to windings 110, armature 112 and armature pin 114 may be moved upward away from nozzle 60. As armature pin 114 moves upward, control chamber 80 may be fluidly connected with low-pressure outlet 70, thereby causing control chamber 80 to empty. At this point in time, the high-pressure fluid acting on hydraulic surface 108 may overcome the bias of spring 94, thereby causing needle element 62 to move upwards away from orifices 104 and initiate the injection event.

To end the injection event, solenoid actuator 64 may be de-energized to allow spring 116 to return armature 112 and armature pin 114 back downward until lower seat 118 is engaged by armature pin 114 and the draining of control chamber 80 is stopped. At this point in time, the pressure within control chamber 80 may build until the pressure acting on hydraulic surface 106 is sufficient, together with the bias of spring 94, to return needle element 62 to the flow-blocking position against orifices 104.

During movement of armature 112, pressure fluctuations may be generated within cavity 115 that cause armature 112 to oscillate in an undesired manner (i.e., to bounce). Specifically, as armature 112 moves downward, a flow of high-pressure fuel from within cavity 115 and under armature 112 may be forced around a periphery of armature 112 to above armature 112 and, when armature 112 subsequently moves upward, a low-pressure area under armature 112 may be created that draws the high-pressure fuel back down. Accordingly, the area under and above armature 112 may undergo cyclical pressure fluctuations, from low-pressure to high-pressure to low-pressure, etc. In conventional fuel injectors, these fluctuations in pressure do not end immediately when windings 110 are suddenly energized or suddenly de-energized. Instead, the pressure fluctuations slowly dissipate and, while dissipating, may cause continued reciprocations of armature 112. In some situations, the continued reciprocations of armature 112 may be sufficient to cause needle element 62 to open orifices 104 when no injections of fuel are desired.

With the use of insert 122, however, armature cavity 115 may be kept at relatively consistent low-pressure by the action of venturi 132. That is, the flow of coolant (i.e. low-pressure fuel) through effuser, neck, and diffuser portions 134, 138, 136, may cause a low-pressure to develop within passage 140 that draws down the pressure within cavity 115. In one embodiment, the pressure may be drawn down to near the vapor pressure of the fuel, thereby causing the fuel to boil and create bubbles in the space between armature 112 and insert 122. These bubbles may function as shock absorbers to dampen the undesired pressure fluctuations and/or oscillating movements of armature 112.

Because insert 122 may create a dampening environment for armature 112, the likelihood of needle element 62 moving enough to unblock orifices 104 after an intended injection event should have terminated may be reduced. This reduction may result in smoother and more efficient performance of engine 10.

It will be apparent to those skilled in the art that various modifications and variations can be made to the fuel injector of the present disclosure without departing from the scope of the disclosure. Other embodiments will be apparent to those skilled in the art from consideration of the specification and practice of the fuel injector disclosed herein. It is intended that the specification and examples be considered as exemplary only, with a true scope of the disclosure being indicated by the following claims and their equivalents.

What is claimed is:

1. A fuel injector, comprising:

a fuel nozzle having at least one injection orifice;

a needle element having a tip end and a base end and being movable within the fuel nozzle between a first position at which the tip end of the needle element inhibits fuel flow through the at least one injection orifice and a second position at which fuel flow through the at least one injection orifice is substantially uninhibited by the tip end of the needle element;

a control chamber located at the base end of the needle element;

a body;

a control valve disposed within the body and movable to selectively drain the control chamber, thereby causing the needle element to move between the first and second positions;

an armature disposed within an armature cavity of the body and selectively energized to move the control valve; and a pressure reducer disposed within the body and configured to reduce a pressure of the armature cavity;

the fuel injector being configured to receive a high-pressure fuel for injection, and a low-pressure fuel for cooling, wherein the low-pressure fuel is directed through the pressure reducer, and wherein the pressure reducer includes a venturi having an effuser portion, a neck portion, and a diffuser portion configured to receive the low-pressure fuel, and a passage that extends from the armature cavity to the neck portion.

2. An insert for use in the armature cavity of the fuel injector of claim 1, the insert comprising:

an upper surface configured to fluidly communicate with the armature cavity;

a lower surface located opposite the upper surface and configured to engage a wall of the armature cavity;

a central bore passing from the upper surface to the lower surface and configured to receive a pin connected to the armature;

a first passage formed at least partially within the lower surface and along with at least a portion of the wall of the armature cavity forming the effuser portion, the neck portion, and the diffuser portion of the venturi; and the passage that extends from the armature cavity to the neck portion being formed by a second passage extending through the insert from the neck portion to the upper surface.

3. The insert of claim 2, wherein the effuser portion has a greater inlet opening area and a shorter length than an outlet opening area and length of the diffuser portion.

4. The insert of claim 2, wherein the first passage is formed at least partially by a shoulder of the armature cavity.

5. The insert of claim 2, further including a third passage substantially identical to the first passage formed at least partially within the lower surface.

6. The fuel injector of claim 1, wherein the pressure reducer is configured to reduce the pressure of the armature cavity to below a vaporization point of fluid within the armature cavity.

7. The fuel injector of claim 1, wherein the pressure reducer is configured to generate bubbles within the armature cavity.

8. The fuel injector of claim 1, wherein the pressure reducer further includes a protrusion configured to retain a spring.

9. The fuel injector of claim 8, wherein the pressure reducer further includes a central bore through the protrusion that is configured to guide a control valve.

10. The fuel injector of claim 1, wherein the venturi has a length greater than an outer radius of the pressure reducer.

11. The fuel injector of claim 1, wherein:

the venturi has a length less than an outer radius of the pressure reducer;

the venturi is a first venturi; and the pressure reducer includes a second venturi substantially identical to the first venturi.

12. The fuel injector of claim 1, wherein:

the venturi is located at an interface of the pressure reducer and a shoulder of the armature cavity; and the venturi is partially formed by the shoulder of the armature cavity.

13. The fuel injector of claim 1, wherein the effuser portion has a greater inlet opening area and a shorter length than an outlet opening area and length of the diffuser portion.

14. A method of injecting fuel, comprising:

directing high-pressure fuel into the nozzle of the fuel injector of claim 1;

directing low-pressure fuel into the armature cavity of the fuel injector;

energizing the armature within the armature cavity to allow the high-pressure fuel to be discharged from the nozzle; and reducing a pressure of the low-pressure fuel within the armature cavity below a vaporization point with the pressure reducer.

* * * * *